United States Patent [19]

Garavuso

[11] Patent Number: 5,056,604

[45] Date of Patent: Oct. 15, 1991

[54] SHEET FEEDER DEVICES

[75] Inventor: Gerald M. Garavuso, Farmington, N.Y.

[73] Assignee: Xerox Corporation, Stamford, Conn.

[21] Appl. No.: 517,885

[22] Filed: May 2, 1990

[51] Int. Cl.[5] ..... B65H 3/32

[52] U.S. Cl. ..... 271/113; 271/121; 271/124; 271/127

[58] Field of Search ..... 271/18, 109–110, 271/113–114, 117, 119–120, 126–127, 145, 147, 160, 162, 264, 266, 121, 124, 125

[56] References Cited

U.S. PATENT DOCUMENTS

| | | | |
|---|---|---|---|
| 3,768,803 | 10/1973 | Stange | 271/121 |
| 3,949,979 | 4/1976 | Taylor et al. | 271/117 |
| 4,496,145 | 1/1985 | Fukui | 271/122 |
| 4,526,358 | 7/1985 | Ura et al. | 271/124 |
| 4,572,498 | 2/1986 | Shiozawa | 271/121 |
| 4,588,181 | 5/1986 | Sakata et al. | 271/121 |
| 4,623,138 | 11/1986 | Sakamaki et al. | 271/160 |
| 4,627,607 | 12/1986 | Ishii | 271/122 |
| 4,801,134 | 1/1989 | Yokoyama et al. | 271/122 |
| 4,815,724 | 3/1989 | Sumida et al. | 271/121 |
| 4,822,023 | 4/1989 | Miyoshi | 271/118 |
| 4,830,353 | 5/1989 | Hendriks et al. | 271/117 |
| 4,922,291 | 5/1990 | Adachi | 271/121 |
| 4,925,062 | 5/1990 | Tsukamoto et al. | 271/114 |

FOREIGN PATENT DOCUMENTS

| | | | |
|---|---|---|---|
| 0295844 | 12/1987 | Japan | 271/127 |
| 0281233 | 11/1989 | Japan | 271/121 |

*Primary Examiner*—H. Grant Skaggs
*Attorney, Agent, or Firm*—William A. Henry, II

[57] ABSTRACT

A device for extracting sheets seriatim from the top of a stack of sheets and feeding them to a downstream sheet-using device, includes a pivoted tray which supports a stack of sheets; a nudger roll disposed at a fixed location above the tray and with which the top sheet of the stack can be brought into contact to slide the top sheet in a sheet-feed direction by frictional engagement when the nudger roll is rotated in a feed direction; a retard pad mounted for pivotal movement about an axis at or near the movable end of a first lever of which its other end is mounted for pivotal movement about a fixed support, the pad being biased into frictional engagement with either the nudger roll or a separate sheet-feed roll, the retard pad having movable with it a first arm of which movement about the pivotal axis of the pad is effective to increase the mechanical bias on a pivotally-mounted second lever adapted to urge the tray towards the nudger.

7 Claims, 2 Drawing Sheets

SHEET FEEDER DEVICES

BACKGROUND OF THE INVENTION

This invention relates to sheet feeders, by which is meant devices associated with a xerographic or other reproduction machines (to be referred to as a 'copier' in this specification) for feeding sheets of paper or other copy material on demand from a stack of sheets. In such machines it is usual to use a so-called 'nudger' roll in frictional engagement with the top sheet of the stack for extracting the top sheet from the stack and feeding it into the nip of a pair of sheet-feed rolls. Sometimes, because of high sheet-to-sheet friction, the next sheets(s) in the stack is dragged by the top sheet into the nip, resulting in two or more partially-overlapping (shingled) sheets being fed to a downstream sheet-using device, such as the engine of a copier. This almost inevitably results in a 'paper jam', disturbing the smooth operation of the copier and requiring the manual intervention of an operator, which reduces the productivity of the copier.

In the past, this problem of 'multi-feeds' has been countered by the provision of a retard pad or roll cooperating with the nudger or other sheet-feed roll. The retard pad is designed to bear on the roll, and have a surface of friction material. When a single sheet enters the nip formed by the roll annd pad, the friction between the roll and the sheet is greater than that between the sheet and the pad, so that the sheet is driven by rotation of the roll, sliding over the retard pad as it does so. If two or more shingled sheets enter the nip, then the friction between the sheets is lower than that between the roll and the top sheet, and that between the second sheet and the pad. The second sheet is therefore brought to a halt by frictional contact with the pad, with the top sheet sliding over it until the trail edge of the top sheet has left the nip, whereupon the stalled or retarded second sheet becomes the top sheet and can be fed if the feed roll is still rotating.

It is known from U.S. Pat. No. 4,496,145 to use a coaxial sheet-separating roll coated with frictional material, and a feed roll follower. The follower rotates with the feed roll, while the separator roll is rotated against the sheet-feed direction to prevent paper jams because of multi-sheet feeding.

U.S. Pat. No. 4,627,607 discloses the use of a separator roll adapted to rotate in the opposite direction to a feed roll, and with a chosen torque, to prevent multi-sheet feeds. U.S. Pat. No. 4,801,134 discloses preventing multi-feeds by using a spring-biased paging roll to engage a sheet-feed roll frictionally to apply a sheet-retarding force opposing forward sheet propagation. U.S. Pat. No. 4,822,023 discloses the use of two contra-rotating rolls, of which the upper one acts as the main feed roll, while the lower one applies frictional forces to the underside of a sheet being fed, in order to prevent multi-feeds.

JP-A-61-243 741 discloses the use of a spring-biased stack tray; a movable pick-up roll; a feed roll, and a reverse roll forming a nip with the feed roll to prevent multi-feeds.

U.S. Pat. No. 4,830,353 discloses the use of a biassed stack tray to urge a stack of sheets towards a conveyor roll at a fixed location. Rotation of the conveyor roll feeds a sheet to the nip between a feed roll and a spring-biased pivoted retard block having a layer of frictional material opposing the feed roll. The friction surface forms an acute angle with the radius of the feed roll which passes through the pivot axis of the block, and is effective to prevent multi-feeds. In this specification, the biassing of the stack tray is done by a pair of tension springs, which act along the line of the centre of gravity of the stack, so that the stack can tilt by virtue of its contact with the friction roll.

Accordingly, as an improvement over the above-mentioned systems, the present invention aims at providing a sheet feeder in which the force urging a stack of sheets upwardly into contact with a sheet extractor roll is automatically augmented when there is no sheet in the nip between a sheet-feed roll and an angularly-movable retard member. By judicious choice of spring values, the nip and stack forces can be reduced, resulting in less drag-out, lower force requirements and a reduced occurrence of multi-feeds.

BRIEF DESCRIPTION OF THE DRAWINGS

The present invention will now be described by way of example with reference to the accompanying drawings, in which.

DETAILED DESCRIPTION

Figure 1:
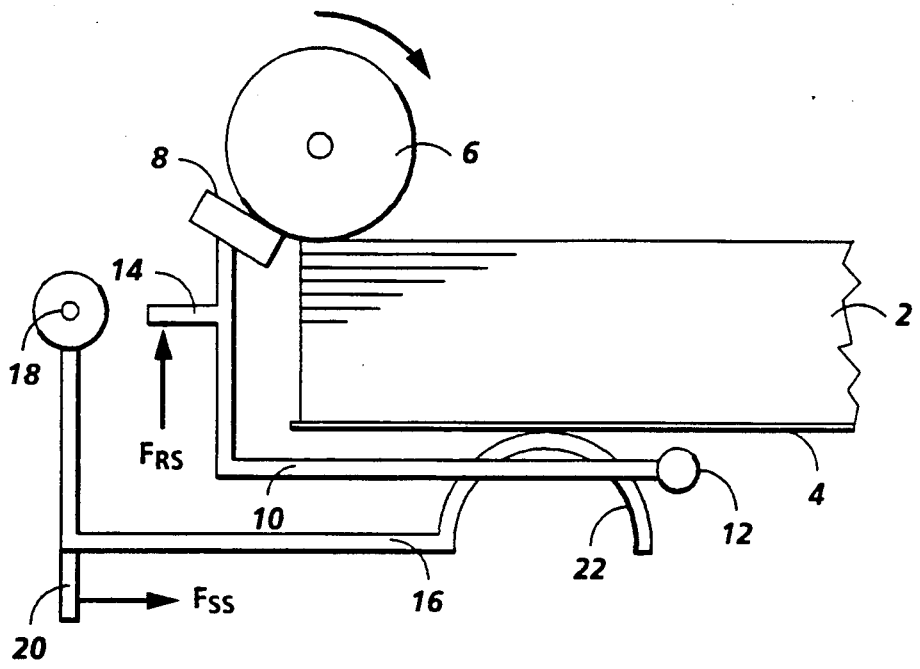
FIG. 1 PRIOR ART
FIG. 1 is a diagrammatic side elevation of a known sheet-feeder incorporating a relatively fixed retard pad in conjunction with a combined nudger/feed roll.

In that known sheet-feeder shown in FIG. 1, a stack 2 of individual sheets of paper or other copy medium is supported on a tray 4 which is pivoted by conventional means at a point outside the right-hand end of the drawing so that the free end of the tray can move in an arc in which it would intercept a feed roll 6 if it were not for the intervening stack. The roll 6 is designed to be driven about a fixed axis by an intermittently operated motor (not shown) which is controlled by a downstream sheet-using device (not snown) to which single sheets are intended to be fed on demand. When roll 6 is rotated, its surface has such a frictional grip on the top sheet of the stack that the sheet is driven to the left as viewed, into the nip formed between the roll 6 and a relatively-stationary retard pad 8 of frictional material. The pad 8 is carried on an angled lever 10 which is pivoted at 12, the pad 8 being urged into frictional engagement with roll 6 by means of a spring (compression or tenion) acting on a spring seat 14 projecting from lever 10 in the direction of the arrow with a force $F_{RS}$, where $F_{RS}$ is the force applied to angled lever 10 by, for example, a compression spring.

The weight of the stack 2 is borne by an angled biassing lever 16 designed for movement about a pivot 18. The lever is biassed to move in an anti-clockwise direction as viewed by means of a suitable spring, for example, a tension spring acting on a spring seat 20 in the direction of the arrow with a force of $F_{SS}$, where $F_{SS}$ is the force applied to the stack angled biassing level 16 by the tension spring. The spring which supplies force $F_{SS}$ is chosen such that it will produce a force which decreases as the sheets are fed and the weight of the stack decreases thereby generating a near constant force on the roll. The feed end of lever 16 is formed into an arc 22 designed to apply an upward bias to the undersurface of tray 4 irrespective of the tray's angle to the horizontal over the range corresponding to the maximum thickness of the stack 2. The dimensions of lever 16 and its mounting, and the force applied to seat 20 by the respective spring, are chosen so that the lever 16 applies to the tray a force sufficient to bear the weight of the stack 2 and to urge the top sheet of the stack into frictional engagement with roll 6. As sheets are extracted from the stack seriatim, the tray 4 pivots about its axis under the action of lever 16, with the spring acting on seat 20 being rated so as to allow for the corresponding pivotal movement about axis 18.

Figure 2:
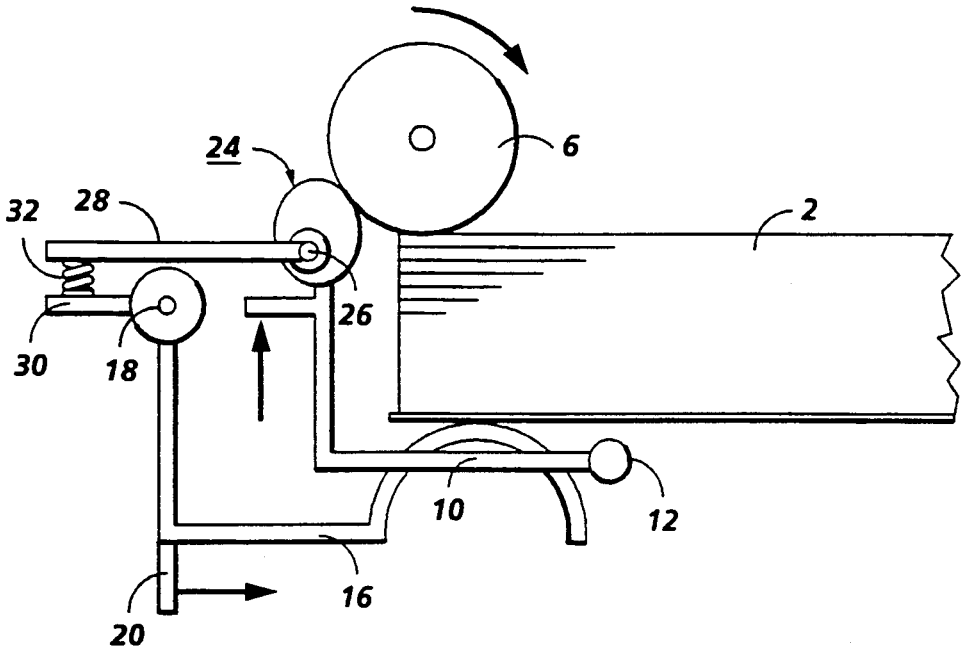
FIG. 2 is a view, similar to FIG. 1, of a sheet feeder of this invention showing the means by which movement of a retard member is used to augment the sheet stack force.

In that embodiment of the invention shown in FIG. 2, like parts are given the same references as in FIG. 1. In this embodiment, the feed roll 6 is engaged by an eccentrically-mounted retard roll 24 movable about 26. Movable with roll 24 is an arm 28 designed to extend substantially in parallel with an arm 30 movable with lever 16 about axis 18. Extending between the two arms is a compression spring 32. The roll 24 is made, or has a surface, of a material presenting an appropriate coefficient of friction with respect to the material of feed roll 6. Because of the eccentric mounting of retard roll 24, it will be appreciated that as it pivots about axis 26, the distance between the axis of feed roll 6 and pivot 26 changes (assuming that they are always in contact with each other), such changes being taken up by the spring moving lever 10 about axis 12 so that irrespective of its pivotal position, the retard roll 24 is urged towards the feed roll with a substantially-constant force.

When the feed roll 6 is being rotated and no sheet has yet entered the nip, the frictional forces between rubber to rubber rolls 6 and 24 are very high with a coefficient of friction of greater than 2.0 and are effective to cause roll 24 to pivot anti-clockwise as viewed. In so doing, it causes arm 28 to pivot to increase the compression on spring 32. This in turn augments the force applied to lever 16 via seat 20, and thus causes the stack 2 to be biassed upwardly by a greater force, thus tending to increase the drag applied to the top sheet of the stack by feed roll 6. When this increased force enables the feed roll 6 to extract the top sheet from the stack and feed it into the nip of the two rolls, the retard roll 24 slides on the undersurface of the sheet, pivoting in a clockwise direction as viewed. This clockwise movement is sufficient to engage and stop any second or more sheets tending to be dragged off the stack with the top sheet. The same movement is effective to allow arm 28 to pivot to reduce the compression on spring 32, thereby reducing the stack-biassing force, thus tending to reduce the friction force between the now-moving top sheet and feed roll 6. Also, and more importantly, this action reduces the drive force applied to sheet #2 by sheet #1. As is already known, when the trail edge of the top sheet has left the nip, the feed roll 6 is able to engage the stalled second sheet and urge it into the nip. It is only when the feed roll is being rotated, and there is no paper in the nip, that the feed roll adequately drives retard roll 24 to appreciably increase the stack force applied by bracket 16 as described above.

Figure 3:
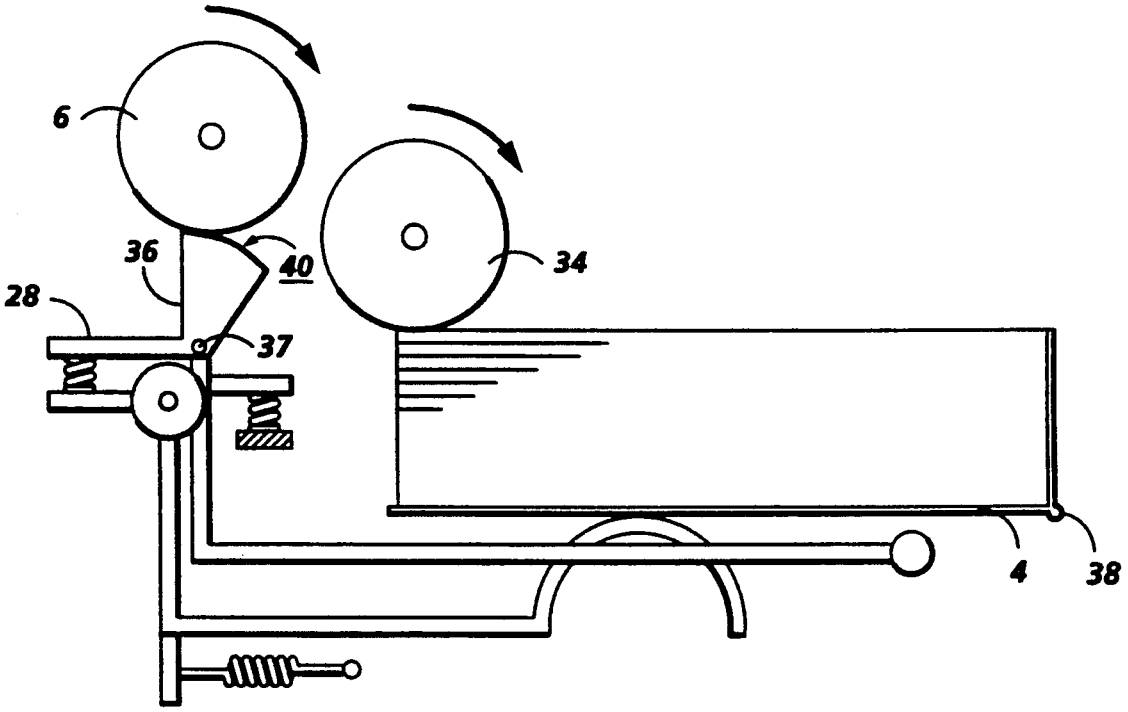
FIG. 3 is a view, similar to FIG. 2, of a modified form of the FIG. 2 device.

That embodiment shown in FIG. 3 uses a separate nudger roll 34 to feed the top sheet into the nip between a separate feed roll 6 and a retard member 36 in the form of an arcuate sector integral with arm 28. As is usual, both rolls 34 and 36 are driven in the same direction by the same motor at the same speed. However, this separation of the sheet-extraction and sheet-feed functions does not effect the operation of the machine, in that feed roll 6 tends to pivot retard sector 36 about axis 37 as long as there is no paper in the nip. Just for completeness, the sheet tray 4 is shown diagrammatically as being pivotable about a pivotal axis 38.

Although different compression and tension springs have been shown in the drawings, it is obvious that tension spring could be replaced by a compression spring, and conversely. Also, although the retard member 36 is shown as having an arcuate frictional surface 40, having a centre of curvature spaced from axis 37, the invention would work if it had its centre of curvature at axis 18, i.e. if the retard member 36 were a section of a right cylinder.

Accordingly, it has been shown that the present invention provides a sheet-feeder device of simple construction in which the absence of a sheet from a feeder nip cause the sheet to be extracted to be biassed more firmly into contact with its associated feed roll, as claimed in the appended claims.

I claim:

1. A device for extracting sheets seriatim from the top of a stack of sheets and feeding them to a downstream sheet-using device, including: a pivotable tray adaped to support a stack of sheets; means for pivoting said tray in a counter clockwise direction; a feed roll disposed at a fixed location above said tray and adapted to contact and slide the top sheet of the stack in a sheet-feed direction by frictional engagement when said feed roll is rotated in a feed direction; a first lever adapted for movement about a fixed support, said fixed support being positioned below the lowest position of said tray; a retard pad mounted for pivotal movement about an axis at or near a movable end of said first lever means for biasing said retard pad into frictional engagement with said feed roll, said retard pad including a first arm; a pivotally mounted second lever adapted to urge said tray towards said feed roll, said second lever being movably connected to said first lever such that movement of said first arm about said pivotal axis of said retard pad is effective to increase the mechanical bias of said second lever to thereby urge said tray towards said feed roll, and wherein said second lever is mounted to pivot about said axis of said retard pad; a second arm movable with said second lever and projecting substantially in parallel with said first arm; and a spring between said first and second arms, whereby said first arm is initially driven by said feed roll in a direction in which it increases the force applied by said spring to said second arm so as to augment the force applied to said tray by said second lever.

2. A device as claimed in claim 1, in which said second lever is spring-biased to pivot in the direction in which an end thereof bears on the underside of said tray.

3. A device as claimed in claim 1, in which a nudger roll is provided upstream of said feed roll, means being provided to drive both said nudger and feed rolls in unison at the same speed, said retard pad being adapted to bear on said feed roll to form a nip which is in line with a nip formed between said nudger roll and the top of the stack.

4. A device as claimed in claim 1, in which said retard pad takes the form of a roll having an outer cylindrical surface in direct frictional contact with said feed roll.

5. A device as claimed in claim 4, in which said retard roll is adapted to pivot about an axis which is eccentric with the center of curvature of the roll surface.

6. A device as claimed in claim 1, in which said retard pad takes the form of a member adapted to pivot about said first lever, said member having a part-cylindrical friction surface and a pivotal axis.

7. A device as claimed in claim 6, in which the center of curvature of the friction surface is displaced from said pivotal axis of said member.

* * * * *